US007779926B2

(12) United States Patent
Turley et al.

(10) Patent No.: US 7,779,926 B2
(45) Date of Patent: Aug. 24, 2010

(54) WELLBORE PLUG ADAPTER KIT AND METHOD OF USING THEREOF

(75) Inventors: Rocky A. Turley, Houston, TX (US); W. John McKeachnie, Vernal, UT (US)

(73) Assignee: Weatherford/Lamb, Inc., Houston, TX (US)

( * ) Notice: Subject to any disclaimer, the term of this patent is extended or adjusted under 35 U.S.C. 154(b) by 121 days.

(21) Appl. No.: 11/567,102

(22) Filed: Dec. 5, 2006

(65) Prior Publication Data

US 2008/0128133 A1 Jun. 5, 2008

(51) Int. Cl.
*E21B 33/12* (2006.01)
*E21B 43/11* (2006.01)
*E21B 23/00* (2006.01)
*E21B 33/13* (2006.01)

(52) U.S. Cl. ..... 166/387; 166/297; 166/123; 166/135; 166/182

(58) Field of Classification Search ..... 166/387, 166/313, 297, 123, 135, 182, 55.1
See application file for complete search history.

(56) References Cited

U.S. PATENT DOCUMENTS 2,737,242 A * 3/1956 Baker ..... 166/123
2,753,942 A * 7/1956 Gardiner ..... 166/123
3,163,225 A * 12/1964 Perkins ..... 166/123
4,102,401 A * 7/1978 Erbstoesser ..... 166/284
4,479,548 A * 10/1984 Gilbert ..... 166/387
4,572,290 A * 2/1986 Clifton ..... 166/123
4,619,319 A * 10/1986 Ringgenberg ..... 166/55.1
5,611,401 A * 3/1997 Myers et al. ..... 166/297
5,669,448 A * 9/1997 Minthorn et al. ..... 166/308.1
5,704,426 A * 1/1998 Rytlewski et al. ..... 166/297
6,142,231 A * 11/2000 Myers et al. ..... 166/297
6,394,184 B2 5/2002 Tolman et al.
6,543,538 B2 4/2003 Tolman et al.
6,575,247 B2 6/2003 Tolman et al.

(Continued)

FOREIGN PATENT DOCUMENTS

WO WO 2007/079047 7/2007

OTHER PUBLICATIONS

GB Search Report, Application No. GB0723647.4, dated Mar. 25, 2008.

(Continued)

*Primary Examiner*—Kenneth Thompson
*Assistant Examiner*—Cathleen R Hutchins
(74) *Attorney, Agent, or Firm*—Patterson & Sheridan, L.L.P.

(57) ABSTRACT

Embodiments of the present invention generally relate to an adapter kit for use between a setting tool and a wellbore plug. In one embodiment, a method for setting a plug in a cased wellbore is provided. The method includes deploying a tool string in the wellbore using a run-in string, the tool string comprising: a setting tool coupled to the run-in string, an adapter kit, comprising an adapter sleeve, and a plug comprising a sealing member. The method further includes actuating the setting tool, wherein the setting tool exerts a force on the adapter sleeve which transfers the force to the plug, thereby expanding the sealing member into engagement with an inner surface of the casing. The method further includes separating the setting tool from the plug, wherein the adapter sleeve remains with the plug.

27 Claims, 7 Drawing Sheets

U.S. PATENT DOCUMENTS

| | | | | |
|---|---|---|---|---|
| 6,712,153 | B2 | 3/2004 | Turley et al. | |
| 6,769,491 | B2 | 8/2004 | Zimmerman et al. | |
| 7,036,602 | B2 | 5/2006 | Turley et al. | |
| 2003/0188860 | A1 | 10/2003 | Zimmerman et al. | |
| 2004/0177952 | A1 * | 9/2004 | Turley et al. | 166/134 |
| 2006/0131031 | A1 | 6/2006 | McKeachnie et al. | |
| 2006/0278405 | A1 | 12/2006 | Turley et al. | |

OTHER PUBLICATIONS

Alpha Oil Tools catalog, BT Wireline Pressure Setting Tool for setting Alpha Oil Tools bridge plugs, frac plugs, & cement retainers.
Baker Oil Tools catalog, Setting Tools, Stinger Subs and Wireline Accessories.
Canadian Office Action for Application No. 2,613,757 dated Sep. 15, 2009.

* cited by examiner

WELLBORE PLUG ADAPTER KIT AND METHOD OF USING THEREOF

BACKGROUND OF THE INVENTION

1. Field of the Invention

Embodiments of the present invention generally relate to an adapter kit for use between a setting tool and a wellbore plug.

2. Description of the Related Art

When a hydrocarbon-bearing, subterranean reservoir formation does not have enough permeability or flow capacity for the hydrocarbons to flow to the surface in economic quantities or at optimum rates, formation treatment, such as hydraulic fracturing or chemical (usually acid) stimulation is often used to increase the flow capacity. A wellbore penetrating a subterranean formation typically consists of a metal pipe (casing) cemented into the original drill hole. Typically, lateral holes (perforations) are shot through the casing and the cement sheath surrounding the casing to allow hydrocarbon flow into the wellbore and, if necessary, to allow treatment fluids to flow from the wellbore into the formation.

Hydraulic fracturing consists of injecting viscous fluids (usually shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it. Granular proppant material, such as sand, ceramic beads, or other materials, is generally injected-with the later portion of the fracturing fluid to hold the fracture(s) open after the pressures are released. Increased flow capacity from the reservoir results from the more permeable flow path left between grains of the proppant material within the fracture(s). In chemical stimulation treatments, flow capacity is improved by dissolving materials in the formation or otherwise changing formation properties.

Typically, a wellbore will intersect several hydrocarbon-bearing formations. Each formation may have a different fracture pressure. To ensure that each formation is treated, each formation is treated separately while isolating a previously treated formation from the next formation to be treated. To facilitate treating of multiple formations in one trip, a first formation may be treated and then isolated from the next formation to be treated using a removable isolation device, such as ball sealers. The ball sealers at least substantially seal the previously treated formation from the next formation to be treated.

FIG. 1A illustrates a prior art wellhead assembly 1 that may be utilized for a one-trip multiple formation treatment operation. The wellhead assembly 1 includes a lubricator system 2 suspended high in the air by crane arm 6 attached to crane base 8. First and second portions of a wellbore 50 have been drilled and lined with surface casing 55*a* partially or wholly within a cement sheath 52*a* and a production casing 55*b* partially or wholly within a cement sheath 52*b*. The depth of the wellbore 50 would extend some distance below the lowest interval to be stimulated to accommodate the length of the perforating device that would be attached to the end of the wireline 30. Wireline 30 is inserted into the wellbore 50 using the lubricator system 2. Also installed to the lubricator system 2 are wireline blow-out-preventors (BOPs) 10 that could be remotely actuated in the event of operational upsets. The crane base 8, crane arm 6, lubricator system 2, BOPs 10 (and their associated ancillary control and/or actuation components) are standard equipment components that will accommodate methods and procedures for safely installing a wireline perforating gun (see FIG. 1B) in the wellbore 50 under pressure, and subsequently removing the wireline perforating gun from a wellbore 50 under pressure.

The lubricator system 2 is of length greater than the length of the perforating gun to allow the perforating device to be safely deployed in a wellbore under pressure. Depending on the overall length requirements, other lubricator system suspension systems (fit-for-purpose completion/workover rigs) could also be used. Alternatively, to reduce the overall surface height requirements a downhole deployment valve could instead be used as part of the wellbore design and completion operations.

Several different wellhead spool pieces may be used for flow control and hydraulic isolation during rig-up operations, stimulation operations, and rig-down operations. The crown valve 16 provides a device for isolating the portion of the wellbore above the crown valve 16 from the portion of the wellbore below the crown valve 16. The upper master fracture valve 18 and lower master fracture valve 20 also provide valve systems for isolation of wellbore pressures above and below their respective locations. Depending on site-specific practices and stimulation job design, it is possible that not all of these isolation-type valves may actually be required or used.

The side outlet injection valves 22 provide a location for injection of treatment fluids into the wellbore. The piping from the surface pumps and tanks used for injection of the treatment fluids would be attached with appropriate fittings and/or couplings to the side outlet injection valves 22. The treatment fluids would then be pumped into the production casing 55*b* via this flow path. With installation of other appropriate flow control equipment, fluid may also be produced from the wellbore using the side outlet injection valves 22. The wireline isolation tool 14 provides a means to protect the wireline from direct impingement of proppant-laden fluids injected in to the side outlet injection valves 22.

FIG. 1B illustrates a prior art ball sealing operation 100 in progress. A tool string assembly 101 is deployed via the wireline 30. The tool string assembly 101 includes a rope-socket/shear-release/fishing-neck sub 110, casing collar-locator 112, a perforation gun 122*a-d* for each formation 150*a-d* to be treated, a setting tool (with adapter kit) 130, and a frac plug 135 (shown already set and detached from tool string 101). Each perforation gun 122*a-d* contains one or more perforation charges 124*a-d* and is independently fired using a select-fire firing head 120*a-d*.

The frac plug 135 has been run-in and set at a first desired depth below a first planned perforation interval 140*a* using the setting tool 130. The tool string 101 was then positioned in the wellbore with perforation charges 120*a* at the location of the first formation 150*a* to be perforated. Positioning of the tool string 101 was readily performed and accomplished using the casing collar locator 112. Then the perforation charges 124*a* were fired to create the first perforation interval 140*a*, thereby penetrating the production casing 55*b* and cement sheath 52*b* to establish a flow path with the first formation 150*a*.

After perforating the first formation 150*a*, the treatment fluid was pumped and positively forced to enter the first formation 150*a* via the first perforation interval 140*a* and resulted in the creation of a hydraulic proppant fracture 145*a*. Near the end of the treatment stage, a quantity of ball sealers 155, sufficient to seal the first perforation interval 140*a*, was injected into the wellbore 50. Following the injection of the ball sealers 155, pumping was continued until the ball sealers 155 reached and sealed the first perforation interval 140*a*. With the first perforation interval 140*a* sealed by ball sealers 155, the tool string 101, was then repositioned so that the perforation gun 122*b* would be opposite of the second formation 150*b* to be treated. The perforation gun 150*b* was then be fired to create the perforation interval 140*b*, thereby penetrating the casing 55*b* and cement sheath 52*b* to establish a flow path with the second formation 150*b* to be treated. The second formation 150*b* may be then treated and the operation continued until all of the planned perforation intervals have been created and the formations 150*a-d* treated.

The prior art setting tool 130 is a hindrance to the fracturing operation 100 due to the relatively small radial clearance between an outer surface of the setting tool 130 and an inner surface of the production casing 55*b*. The setting tool 130 may obstruct delivery of the ball sealers 155 to the intended perforation interval, dislodge ball sealers 155 already set in a particular perforation interval, and/or become stuck in the wellbore due to interference with the ball sealers 155.

Therefore, there exists a need in the art for an improved setting tool and/or adapter kit for setting a wellbore plug.

SUMMARY OF THE INVENTION

Embodiments of the present invention generally relate to an adapter kit for use between a setting tool and a wellbore plug. In one embodiment, a method for setting a plug in a cased wellbore is provided. The method includes deploying a tool string in the wellbore using a run-in string, the tool string comprising: a setting tool coupled to the run-in string, an adapter kit, comprising an adapter sleeve, and a plug comprising a sealing member. The method further includes actuating the setting tool, wherein the setting tool exerts a force on the adapter sleeve which transfers the force to the plug, thereby expanding the sealing member into engagement with an inner surface of the casing. The method further includes separating the setting tool from the plug, wherein the adapter sleeve remains with the plug.

In another embodiment, a tool string for use in a formation treatment operation is provided. The tool string includes a setting tool comprising a setting mandrel and a setting sleeve wherein the setting sleeve is longitudinally moveable relative to the setting mandrel between a first position and a second position. The tool string further includes an adapter kit, comprising an adapter rod and an adapter sleeve, wherein the adapter rod is longitudinally coupled to the setting mandrel and releasably coupled to a plug mandrel, and the adapter sleeve is configured so that when the setting sleeve is moved toward the second position the setting sleeve abuts the adapter sleeve. The tool string further includes a plug comprising the plug mandrel and a sealing member, wherein the sealing member is disposed along an outer surface of the mandrel, and the adapter sleeve is configured to transfer a setting force to the plug, thereby radially expanding the sealing member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
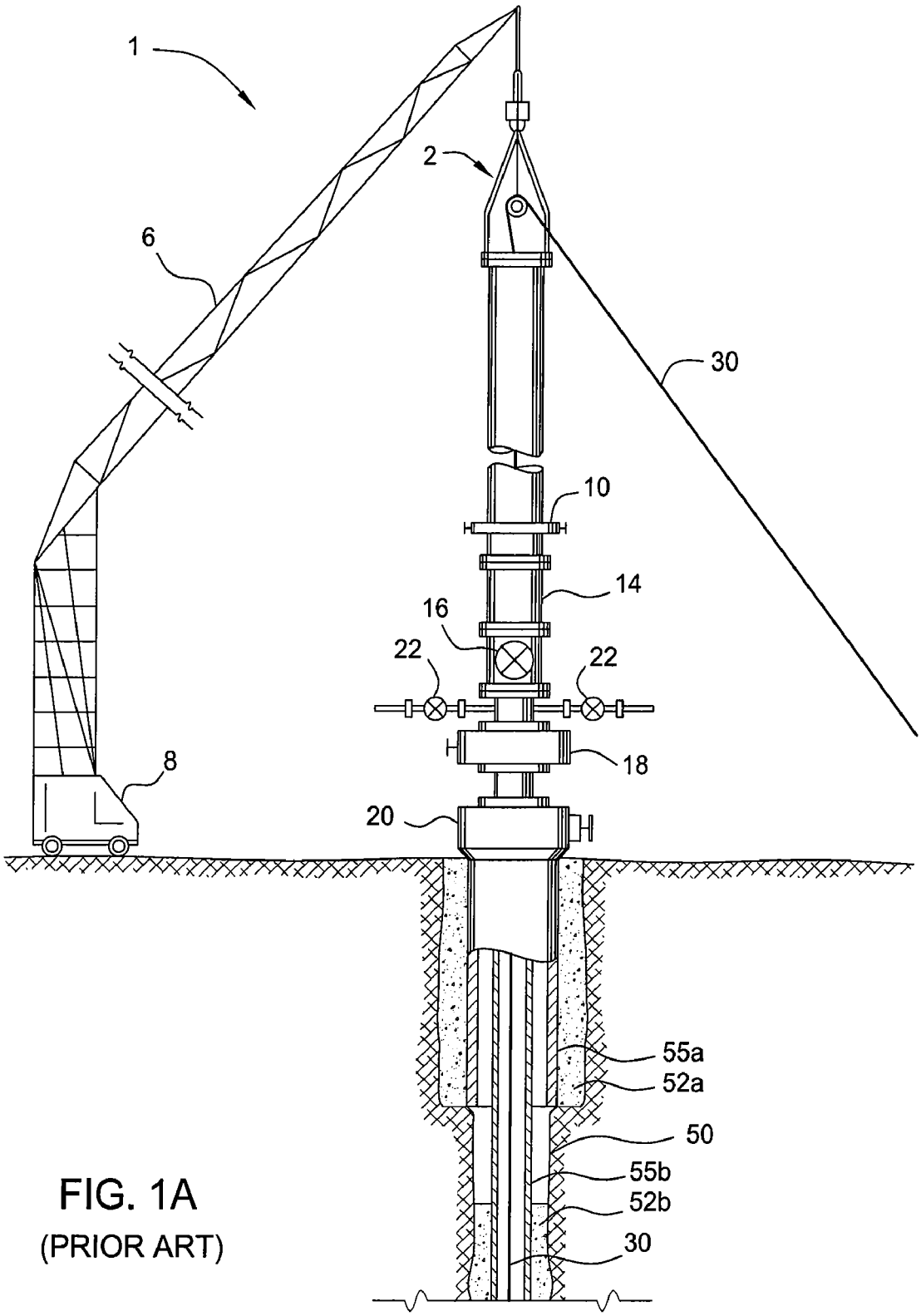
FIG. 1A (PRIOR ART)
FIG. 1A illustrates a prior art wellhead assembly that may be utilized for a one-trip multiple formation treatment operation.
Figure 1B:
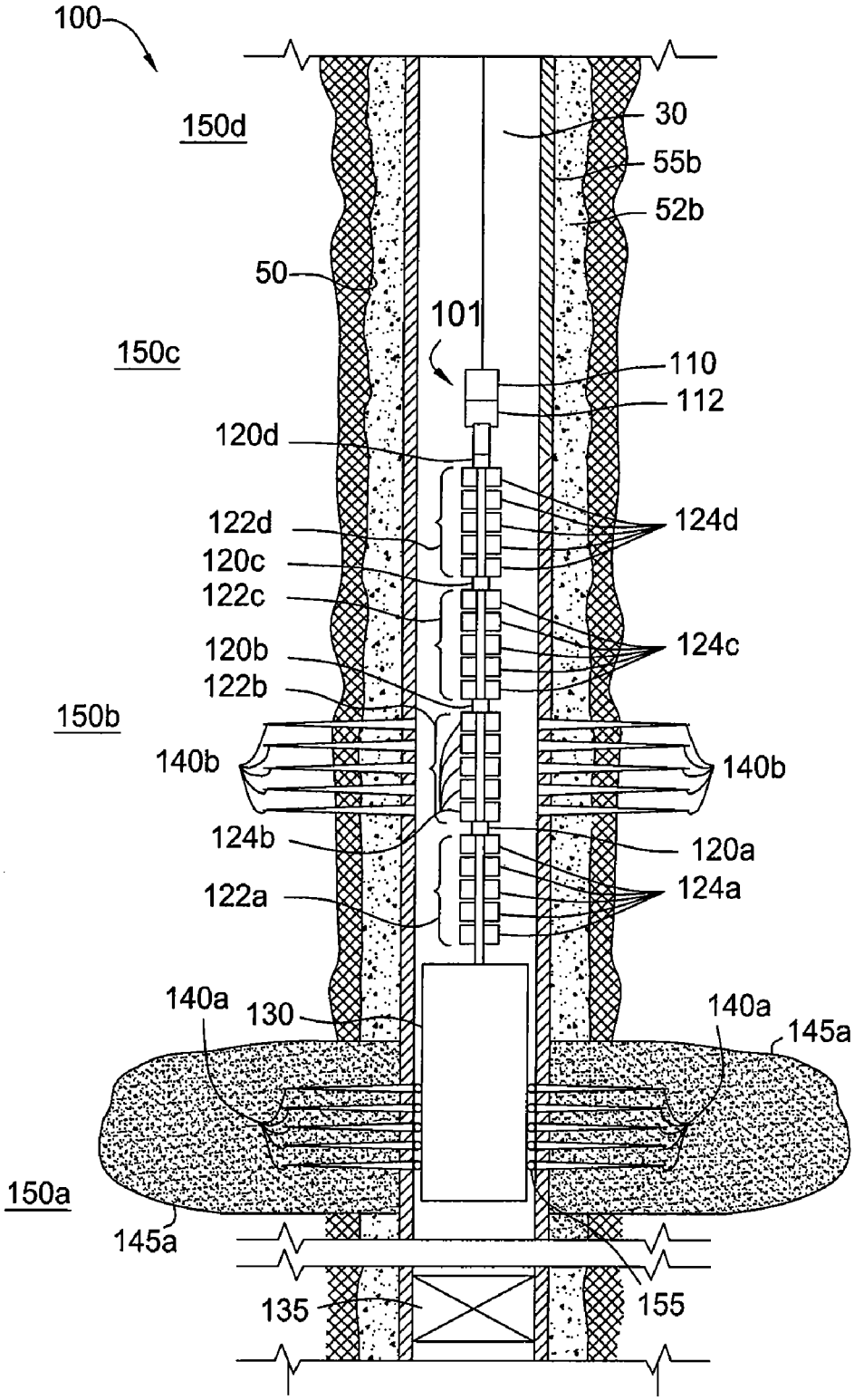
FIG. 1B (PRIOR ART)
FIG. 1B is a schematic of a wellbore showing ball-sealers being used to seal off a fractured formation in a perforated wellbore.
Figure 2:
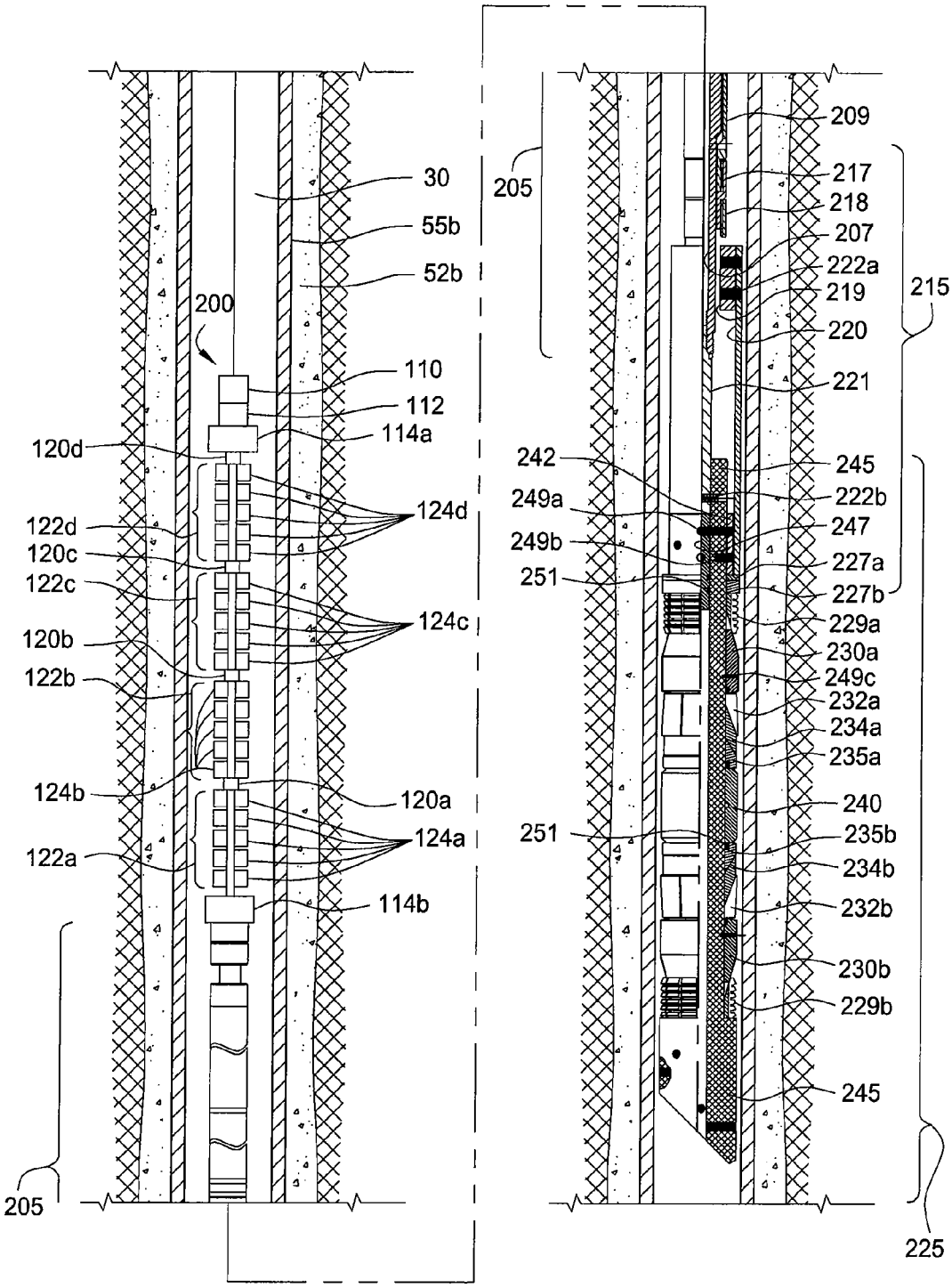
FIG. 2 illustrates a tool string, according to one embodiment of the present invention.
Figure 2A:
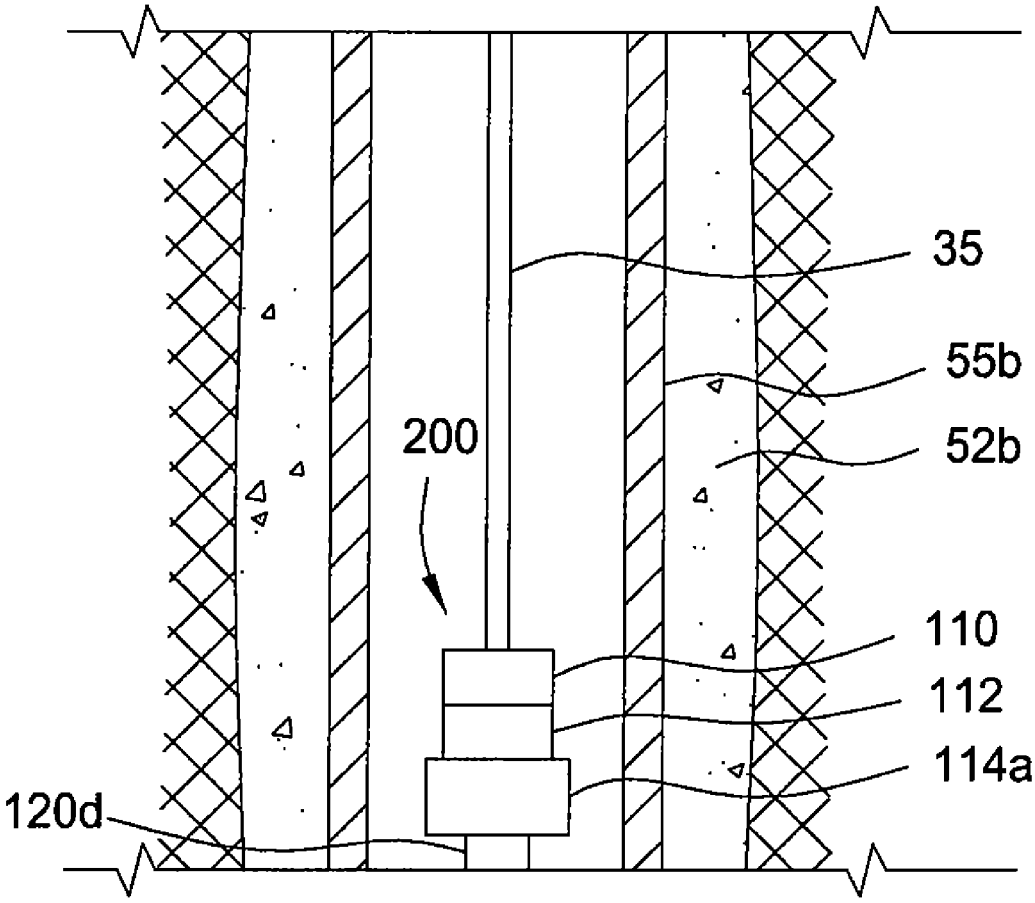
FIG. 2A illustrates the upper portion of a tool string, according to an alternative embodiment of the present invention.

FIG. 2 illustrates a tool string 200, according to one embodiment of the present invention. The tool string 200 may be run into the wellbore using the wellhead assembly 1, illustrated in FIG. 1A and used to perform the fracturing operation 100, illustrated in FIG. 1B. The tool string 200 is deployed via a run-in string, such as a wireline 30. Alternatively, the run-in string may be coiled tubing 35, as shown in FIG. 2A. The tool string 200 may include the rope-socket/shear-release/fishing-neck sub 110, casing collar-locator 112, a perforation gun 122*a-d* for each formation 150*a-d* to be treated, a setting tool 205, an adapter kit 215, and a frac plug 225. Each perforation gun 122*a-d* includes one or more perforation charges 124*a-d* and is independently fired using a select-fire firing head 120*a-d*. Although four perforation guns are shown, two or more perforation guns may be included in the tool string 200.

The frac-plug 225 may include a mandrel 245, first and second slips 229*a,b*, first and second slip cones 230*a,b*, a sealing member 240, first and second element cones 235*a,b*, first and second expansion rings 234*a,b*, and first and second expansion support rings 232*a,b*. The frac-plug assembly 225 is made from a drillable material, such as a non-steel material. The mandrel 245 and the cones 230*a,b* and 235*a,b* may be made from a fiber reinforced composite. The composite material may be constructed of a polymer composite that is reinforced by a continuous fiber such as glass, carbon, or aramid, for example. The individual fibers are typically layered parallel to each other, and wound layer upon layer. However, each individual layer is wound at an angle of about 30 to about 70 degrees to provide additional strength and stiffness to the composite material in high temperature and pressure downhole conditions. The mandrel 245 is preferably wound at an angle of 30 to 55 degrees, and the other tool components are preferably wound at angles between about 40 and about 70 degrees. The difference in the winding phase is dependent on the required strength and rigidity of the overall composite material.

The polymer composite may be an epoxy blend. However, the polymeric composite may also consist of polyurethanes or phenolics, for example. In one aspect, the polymer composite is a blend of two or more epoxy resins. The composite may be a blend of a first epoxy resin of bisphenol A and epichlorohydrin and a second cycloaliphatic epoxy resin. A 50:50 blend by weight of the two resins has been found to provide the required stability and strength for use in high temperature and pressure applications. The 50:50 epoxy blend also provides good resistance in both high and low pH environments. The fiber is typically wet wound, however, a prepreg roving can also be used to form a matrix. A post cure process is preferable to achieve greater strength of the material. Typically, the post cure process is a two stage cure consisting of a gel period and a cross linking period using an anhydride hardener, as is commonly know in the art. Heat is added during the curing process to provide the appropriate reaction energy which drives the cross-linking of the matrix to completion. The composite may also be exposed to ultraviolet light or a high-intensity electron beam to provide the reaction energy to cure the composite material. The slips 229*a,b* may be made from a non-steel metal or alloy, such as cast iron. The sealing member 240 may be made from a polymer, such as an elastomer.

The sealing member 240 is backed by the element cones 235*a,b*. An o-ring 251 (with an optional back-up ring) may be provided at the interface between each of the expansion cones and the sealing member 240. The expansion rings 234*a,b* are disposed about the mandrel 245 between the element cones 235*a,b*, and the expansion support rings 232*a,b*. The expansion support rings 232*a,b* are each an annular member having a first section of a first diameter that steps up to a second section of a second diameter. An interface or shoulder is therefore formed between the two sections. Equally spaced longitudinal cuts are fabricated in the second section to create one or more fingers or wedges there-between. The number of cuts is determined by the size of the annulus to be sealed and the forces exerted on each expansion support ring 232*a,b*.

The wedges are angled outwardly from a center line or axis of each expansion support ring 232*a,b* at about 10 degrees to about 30 degrees. The angled wedges hinge radially outward as each expansion support ring 232*a,b* moves longitudinally across the outer surface of each respective expansion ring 234*a,b*. The wedges then break or separate from the first section, and are extended radially to contact an inner diameter of the surrounding casing 55*b*. This radial extension allows the entire outer surface area of the wedges to contact the inner wall of the casing 55*b*. Therefore, a greater amount of frictional force is generated against the surrounding tubular. The extended wedges thus generate a "brake" that prevents slippage of the frac plug assembly 225 relative to the casing 55*b*.

The expansion rings 234*a,b* may be manufactured from any flexible plastic, elastomeric, or resin material which flows at a predetermined temperature, such as ploytetrafluoroethylene (PTFE) for example. The second section of each expansion support ring 232*a,b* is disposed about a first section of the respective expansion ring 234*a,b*. The first section of each expansion ring 234*a,b* is tapered corresponding to a complimentary angle of the wedges. A second section of each expansion ring 234*a,b* is also tapered to compliment a sloped surface of each respective element cone 235*a,b*. At high temperatures, the expansion rings 234*a,b* expand radially outward from the mandrel 245 and flow across the outer surface of the mandrel 245. The expansion rings 234*a,b* fills the voids created between the cuts of the expansion support rings 232*a,b*, thereby providing an effective seal.

The element cones 235*a,b* are each an annular member disposed about the mandrel 245 adjacent each end of the sealing member 240. Each of the element cones 235*a,b* has a tapered first section and a substantially flat second section. The second section of each element cone 235*a,b* abuts the substantially flat end of the sealing member 240. Each tapered first section urges each respective expansion ring 234*a,b* radially outward from the mandrel 245 as the frac plug assembly 225 is set. As each expansion ring 234*a,b* progresses across each respective tapered first section and expands under high temperature and/or pressure conditions, each expansion ring 234*a,b* creates a collapse load on a respective element cone 235*a,b*. This collapse load holds each of the element cones 235*a,b* firmly against the mandrel 245 and prevents longitudinal slippage of the frac plug assembly 225 once the frac plug assembly 225 has been set in the wellbore. The collapse load also prevents the element cones 235*a,b* and sealing member 240 from rotating during a subsequent mill/drill through operation.

The sealing member 240 may have any number of configurations to effectively seal an annulus within the wellbore. For example, the sealing member 240 may include grooves, ridges, indentations, or protrusions designed to allow the sealing member 240 to conform to variations in the shape of the interior of a surrounding tubular (not shown). The sealing member 240, may be capable of withstanding high temperatures, i.e., four hundred fifty degrees Fahrenheit, and high pressure differentials, i.e., fifteen thousand psi.

The mandrel 245 is a tubular member having a central longitudinal bore therethrough. A plug 247 may be disposed in the bore of the mandrel 245. The plug 247 is a rod shaped member and includes one or more O-rings 251 each disposed in a groove formed in an outer surface of the plug 247. A back-up ring may also be disposed in each of the plug grooves. Alternatively, the mandrel 245 may be solid. The slips 229*a,b* are each disposed about the mandrel 245 adjacent a first end of each respective slip cone 230*a,b*. Each slip 229*a,b* includes a tapered inner surface conforming to the first end of each respective slip cone 230*a,b*. An outer surface of each slip 229*a,b*, may include at least one outwardly extending serration or edged tooth to engage an inner surface of a the casing 55*b* when the slips 229*a,b* are driven radially outward from the mandrel 245 due to longitudinal movement across the first end of the slip cones 230*a,b*.

The slips 229*a,b* are each designed to fracture with radial stress. Each slip 229*a,b* typically includes at least one recessed groove milled therein to fracture under stress allowing the slip 229*a,b* to expand outward to engage an inner surface of the casing 55*b*. For example, each of the slips 229*a,b* may include four sloped segments separated by equally spaced recessed grooves to contact the casing 55*b*, which become evenly distributed about the outer surface of the mandrel 245.

Each of the slip cones 230*a,b* is disposed about the mandrel 245 adjacent a respective expansion support ring 232*a,b* and is secured to the mandrel 245 by one or more shearable members 249*c* such as screws or pins. The shearable members 249*c* may be fabricated from a drillable material, such as the same composite material as the mandrel 245. Each of the slip cones 230*a,b* has an undercut machined in an inner surface thereof so that the cone 230*a,b* can be disposed about the first section of the respective expansion support ring 232*a,b*, and butt against the shoulder of the respective expansion support ring 232*a,b*. Each of the slips 229*a,b* travel about the tapered first end of the respective slip cone 230*a,b*, thereby expanding radially outward from the mandrel 245 to engage the inner surface of the casing 55*b*.

One or more setting rings 227*a,b* are each disposed about the mandrel 245 adjacent a first end of the first slip 229*a*. Each of the setting rings 227*a,b* is an annular member having a first end that is a substantially flat surface. The first end of the first setting ring 227*a* serves as a shoulder which abuts an adapter sleeve 220. A support ring 242 is disposed about the mandrel 245 adjacent the first end of the first setting ring 227*a*. One or more pins 249*b* secure the support ring 242 to the mandrel 245. The support ring 242 is an annular member and serves to longitudinally restrain the first setting ring 227*a*.

The setting tool 205 includes a mandrel 207 and a setting sleeve 209 which is longitudinally movable relative to the mandrel 207. The mandrel 207 is longitudinally coupled to the wireline 30 via the perforating gun assembly 124*a-d*. The setting tool may include a power charge which is ignitable via an electric signal transmitted through the wireline 30. Combustion of the power charge creates high pressure gas which exerts a force on the setting sleeve 209. Alternatively, a hydraulic pump may be used instead of the power charge. If the run-in string is coiled tubing, high pressure fluid may be injected through the coiled tubing to drive the setting sleeve 209.

The adapter kit 215 is longitudinally disposed between the setting tool 205 and the frac plug 225. The adapter kit may include a thread-saver 217, a thread cover 218, an adapter rod 221, the adapter sleeve 220, and an adapter ring 219. Since the thread-saver 217, thread cover 218, and the adapter rod 221 will return to the surface, they may be made from a conventional material, i.e. a metal or alloy, such as steel. The adapter sleeve 220 and the adapter ring 219 may be made from any of the mandrel 245 materials, discussed above. The thread-saver 217 is longitudinally coupled to the setting sleeve 209 with a threaded connection. The thread cover 218 is longitudinally coupled to the thread-saver 217 with a threaded connection. Alternatively, the thread cover 218 and thread saver 217 may be integrally formed.

The adapter rod 221 is longitudinally coupled to the setting mandrel 207 at a first longitudinal end with a threaded connection and longitudinally coupled to the mandrel 245 at a second longitudinal end with one or more shearable members, such as a shear pin 222*b*. The adapter rod 221 also shoulders against a first longitudinal end of the mandrel 245 near the second longitudinal end of the adapter rod 221. The second longitudinal end of the adapter rod 221 abuts a first longitudinal end of the plug 247. The adapter ring 219 is longitudinally coupled to the adapter sleeve 220 at a first longitudinal end of the adapter sleeve 220 with one or more pins 222*a*. The adapter ring 219 is configured so that the thread cover 218 will abut a first longitudinal end of the adapter ring 219 when the setting tool 205 is actuated, thereby transferring longitudinal force from the setting tool 205 to the adapter ring 219. A second longitudinal end of the adapter sleeve 220 abuts a first longitudinal end of the first setting ring 227*a*.

Figure 3:
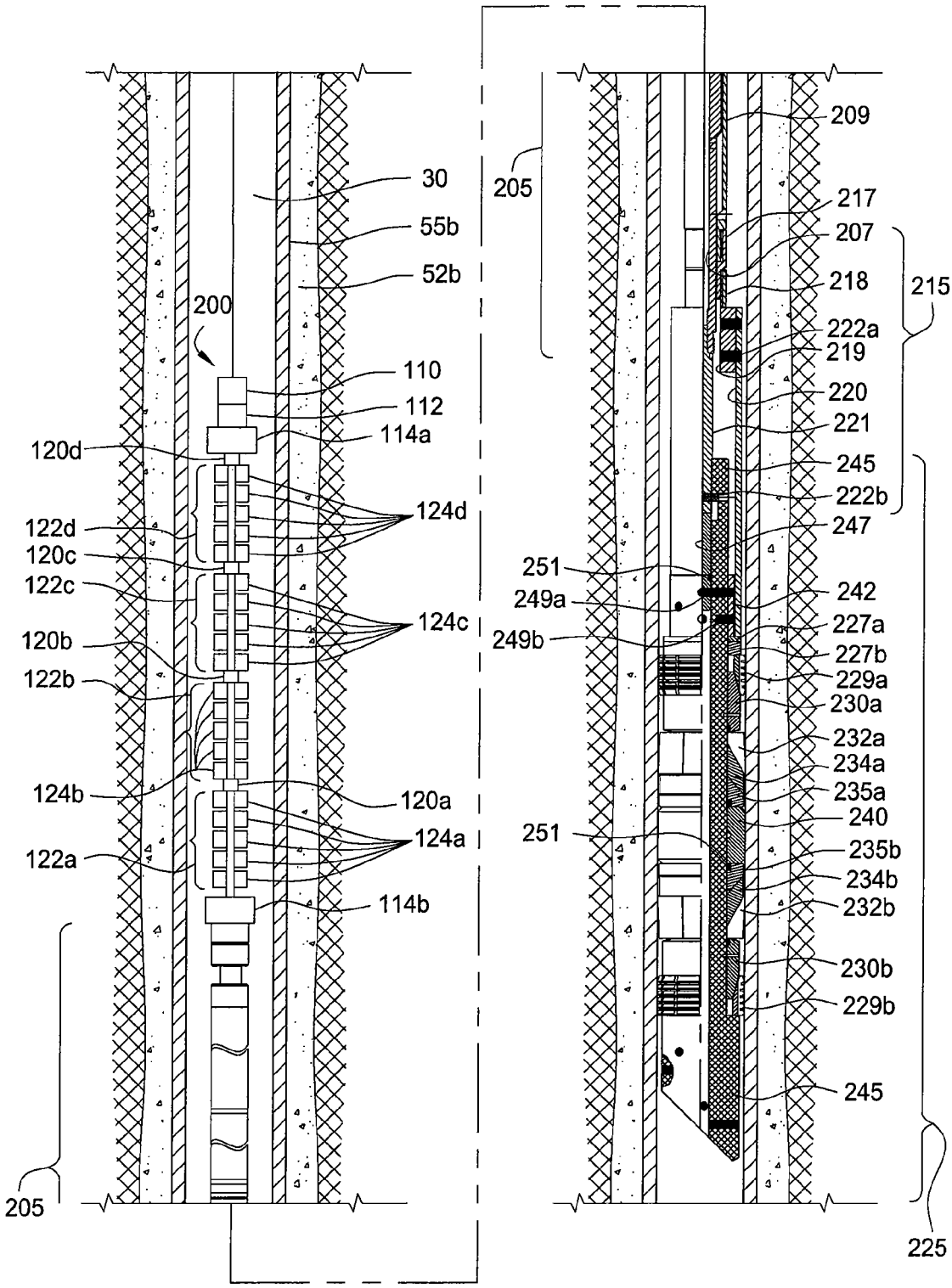
FIG. 3 illustrates the tool string of FIG. 2, wherein a frac plug of the tool string has been set by a setting tool of the tool string but the setting tool has not yet been separated from the frac plug.

FIG. 3 illustrates the tool string 200 of FIG. 2, wherein the frac plug has been set. To set the frac-plug assembly 225, the mandrel 245 is held by the wireline 30, through the setting mandrel 207 and adapter rod 221, as a longitudinal force is applied through the setting sleeve 209 to the adapter sleeve 220 upon contact of the setting sleeve with the adapter sleeve. Alternatively, the wireline may be retracted to the surface during actuation of the frac plug assembly so long as a tensile force exerted by the wireline is less than that required to fracture the shear pin 222*b*. The setting force is transferred to the setting rings 227*a,b* and then to the slip 229*a*, and then to the first slip cone 230*a*, thereby fracturing the first shear pin 249*c*. The force is then transferred through the various members 232*a*, 234*a*, 235*a*, 240, 235*b*, 234*b*, and 232*b* to the second slip cone 230*b*, thereby fracturing the second shear pin 249*c*. Alternatively, the shear pins 249*c* may fracture simultaneously or in any order. The slips 229*a,b* move along the tapered surface of the respective cones 230*a,b* and contact an inner surface of a the casing 55*b*. The longitudinal and radial forces applied to slips 229*a,b* causes the recessed grooves to fracture into equal segments, permitting the serrations or teeth of the slips 229*a, b* to firmly engage the inner surface of the casing 55*b*.

Longitudinal movement of the slip cones 230*a,b* transfers force to the expansion support rings 232*a,b*. The expansion support rings 232*a,b* move across the tapered first section of the expansion rings 234*a,b*. As the support rings 232*a,b* move longitudinally, the first section of the support rings 232*a,b* expands radially from the mandrel 245 while the wedges hinge radially toward the casing 55*b*. At a pre-determined force, the wedges break away or separate from respective first sections of the support rings 232*a,b*. The wedges then extend radially outward to engage the casing 55*b*. The expansion rings 234*a,b* flow and expand as they are forced across the tapered sections of the respective element cones 235*a,b*. As the expansion rings 234*a,b* flow and expand, the expansion rings 234*a,b* fill the gaps or voids between the wedges of the respective support rings 232*a,b*.

The growth of the expansion rings 234*a,b* applies a collapse load through the element cones 235*a,b* on the mandrel 245, which helps prevent slippage of the frac plug 225, once activated. The element cones 235*a,b* then longitudinally compress and radially expand the sealing member 240 to seal an annulus formed between the mandrel 245 and an inner diameter of the casing 55*b*.

Figure 4A:
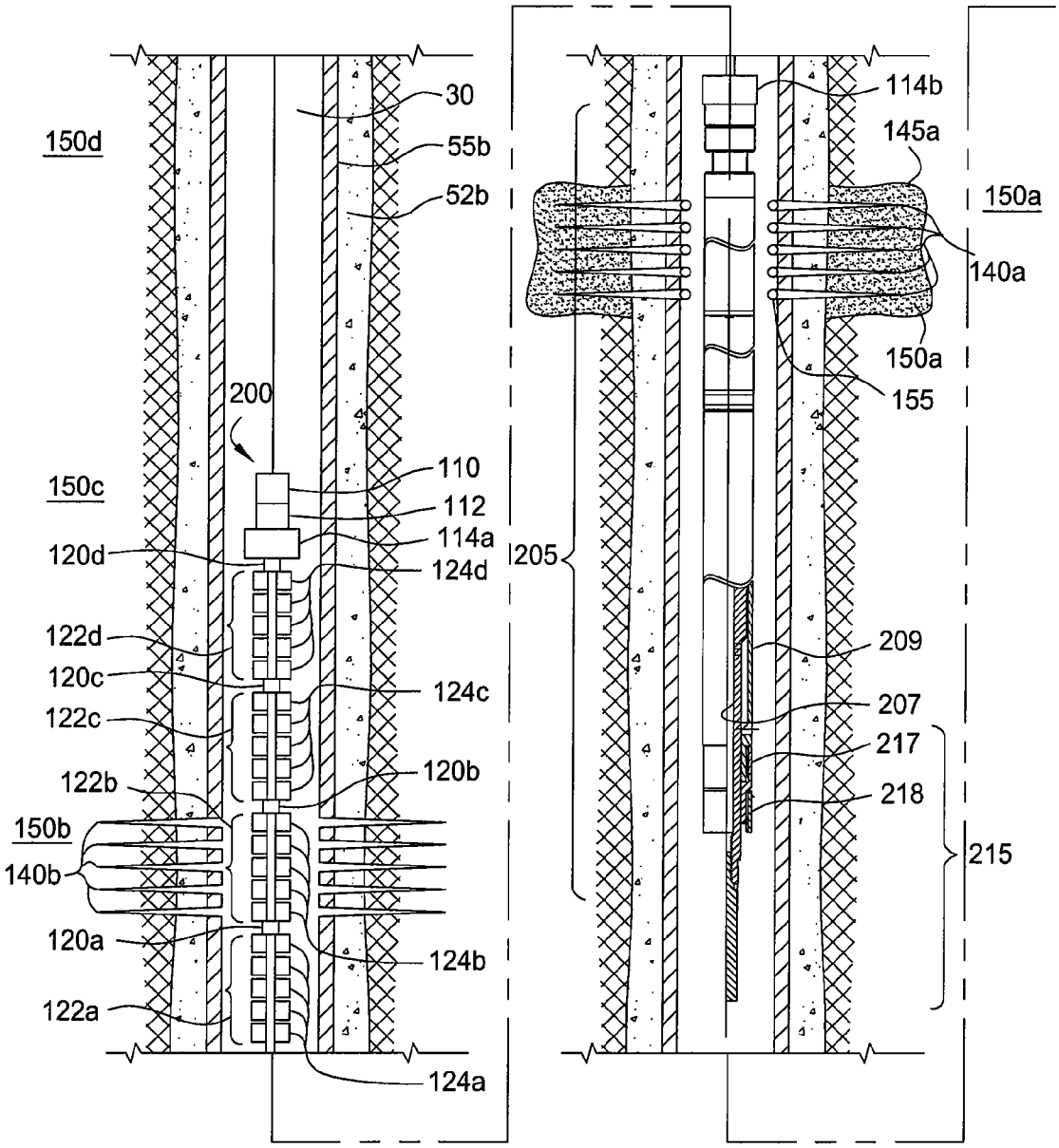
FIGS. 4A and 4B illustrate the tool string of FIG. 2, wherein the setting tool of the tool string has been separated from the frac plug and a setting sleeve of the tool string and a fracture operation has begun using the tool string.
Figure 4B:
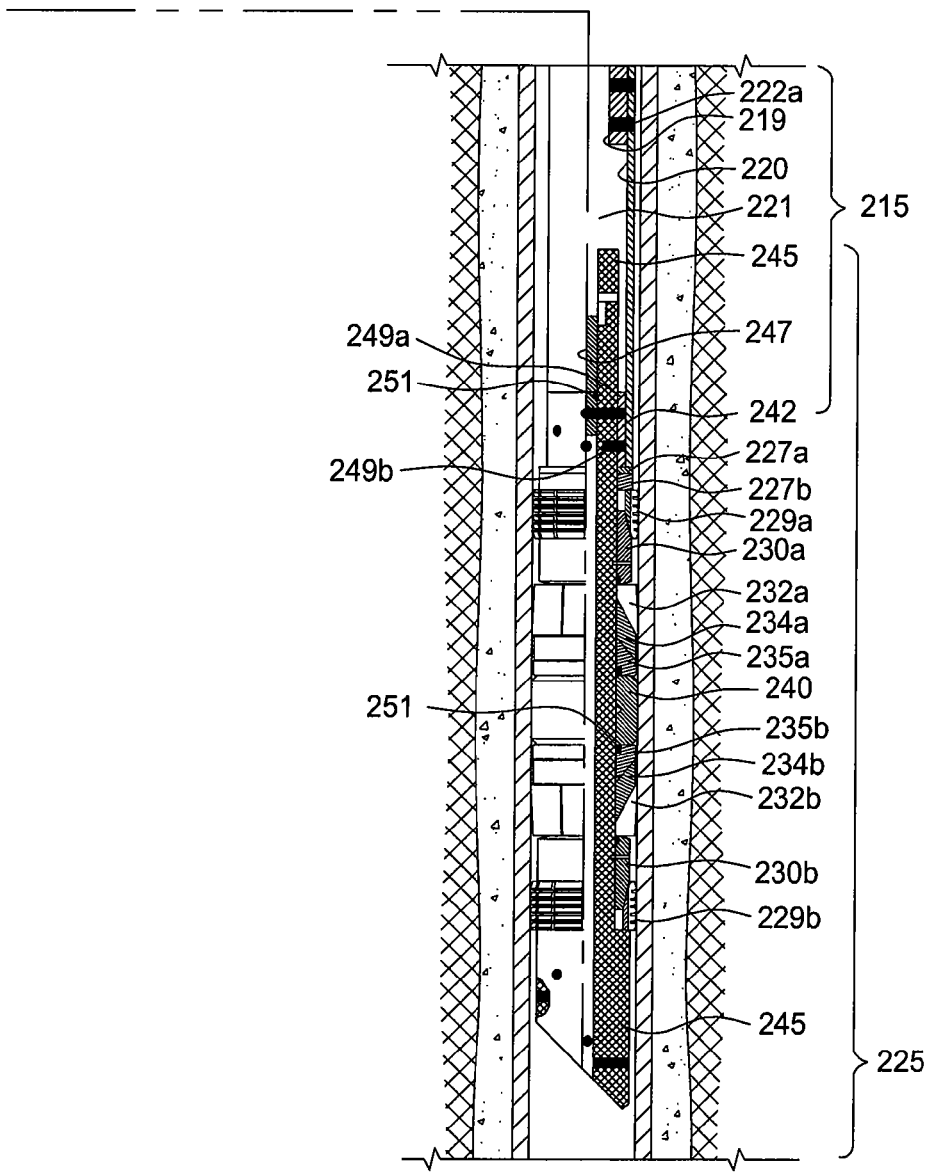

FIGS. 4A and 4B illustrate the tool string 200 of FIG. 2, wherein the setting tool 205 has been separated from the frac plug 225 and setting sleeve 220 and a fracture operation has begun using the tool string 200. Once the frac plug 225 has been run-in and set at a first desired depth below a first planned perforation interval 140*a* using the setting tool 205 and adapter kit 215, a tensile force is then exerted on the shear pin 222*b* sufficient to fracture the shear pin 222*b*. The wireline 30 may then be retracted, thereby separating the tool string 200 from the frac plug 225, adapter sleeve 220, and adapter ring 219. Since the adapter sleeve 220 is left with the frac plug 225, the radial clearance of the tool string 200 with the inner surface of the casing 55*b* is dramatically increased, thereby not interfering with subsequent fracturing/stimulation operations.

The tool string 200 is then positioned in the wellbore with perforation charges 120*a* at the location of the first formation 150*a* to be perforated. Positioning of the tool string 200 is readily performed and accomplished using the casing collar locator 112. Then the perforation charges 124*a* are fired to create the first perforation interval 140*a*, thereby penetrating the production casing 55*b* and cement sheath 52*b* to establish a flow path with the first formation 150*a*.

After perforating the first formation 150*a*, the treatment fluid is pumped and positively forced to enter the first formation 150*a* via the first perforation interval 140*a* and resulted in the creation of a hydraulic proppant fracture 145*a*. Near the end of the treatment stage, a quantity of ball sealers 155, sufficient to seal the first perforation interval 140*a*, is injected into the wellbore 50. The decentralizers 114*a,b* may be activated, before commencement of the treatment or before injection of the ball sealers, to move the tool string 200 radially into contact with the inner surface of the casing 55*b* so as not to obstruct the treatment process. Following the injection of the ball sealers 155, pumping is continued until the ball sealers 155 reach and seal the first perforation interval 140*a*. With the first perforation interval 140*a* sealed by ball sealers 155, the tool string 200, is then repositioned so that the perforation gun 122*b* would be opposite of the second formation 150*b* to be treated. The perforation gun 150*b* is then be fired to create the perforation interval 140*b*, thereby penetrating the casing 55*b* and cement sheath 52*b* to establish a flow path with the second formation 150*b* to be treated. The second formation 150*b* may be then treated and the operation continued until all of the planned perforation intervals have been created and the formations 150*a-d* treated.

Although discussed as separate formations, 150*a-d* may instead be portions of the same formation or any combination of portions of the same formation and different formations. As discussed above with reference to the number of perforation guns 122, two or more formations or formation portions may be treated. Although a fracture operation is illustrated, the tool string 200 may also be used in a stimulation operation.

While the foregoing is directed to embodiments of the present invention, other and further embodiments of the invention may be devised without departing from the basic scope thereof, and the scope thereof is determined by the claims that follow.

The invention claimed is:

1. A method for setting a plug in a cased wellbore, comprising:

deploying a tool string in the wellbore using a run-in string, the tool string comprising:

a setting tool coupled to the run-in string, the setting tool having an outermost surface with a first maximum outer diameter and a first radial clearance between the first maximum outer diameter and an inner surface of the wellbore casing, an adapter kit, comprising an adapter sleeve, the adapter kit having an outermost surface with a second maximum outer diameter and a second radial clearance between the second maximum outer diameter and the inner surface of the wellbore casing, the first radial clearance being substantially greater than the second radial clearance due to the first maximum outer diameter of the setting tool being substantially less than the second maximum outer diameter of the adapter kit, and a plug comprising a sealing member;

actuating the setting tool, wherein the setting tool exerts a force on the adapter sleeve which transfers the force to the plug, thereby expanding the sealing member into engagement with an inner surface of the casing; and separating the setting tool from the plug, wherein the adapter sleeve remains with the plug.

2. The method of claim 1, wherein the run-in string is wireline or coiled tubing.

3. The method of claim 1, wherein the tool string further comprises one or more perforation guns, and the method further comprises perforating the casing at a first location, thereby forming one or more first perforations.

4. The method of claim 3, further comprising injecting formation treatment fluid through the casing and into the formation via the first perforations.

5. The method of claim 4, further comprising removably and at least substantially sealing the first perforations.

6. The method of claim 5, wherein the first perforations are sealed using ball sealers.

7. The method of claim 5, further comprising injecting formation treatment fluid through the casing and into the formation via the first perforations.

8. The method of claim 5, further comprising perforating the casing at a second location, thereby forming one or more second perforations.

9. The method of claim 7, wherein the second perforating act is performed during the same trip as the first perforating act.

10. The method of claim 7, further comprising injecting formation treatment fluid through the casing and into the formation via the second perforations while the first perforations are sealed.

11. The method of claim 1, further comprising retrieving the setting tool from the wellbore.

12. A tool string for use in a formation treatment operation, comprising:

a setting tool comprising a setting mandrel and a setting sleeve, wherein:

the setting sleeve is longitudinally moveable relative to the setting mandrel between a first position and a second position, and the setting tool has an outer surface with a furthest first radial distance from a central axis, the outer surface having a maximum first diameter;

an adapter kit, comprising an adapter rod and an adapter sleeve, wherein:

the adapter rod is longitudinally coupled to the setting mandrel and releasably coupled to a plug mandrel, the adapter sleeve is configured so that when the setting sleeve is moved toward the second position the setting sleeve abuts the adapter sleeve, and the adapter sleeve has an outer surface with a furthest second radial distance from a central axis, the outer surface having a maximum second diameter, the second diameter being substantially greater than the first diameter; and a plug comprising the plug mandrel and a sealing member, wherein:

the sealing member is disposed along an outer surface of the plug mandrel, and the adapter sleeve is configured to transfer a setting force to the plug, thereby radially expanding the sealing member.

13. The tool string of claim 12, wherein the sealing member is made from a polymer.

14. The tool string of claim 12, wherein the plug and the adapter sleeve are made from a drillable material.

15. The tool string of claim 14, wherein the plug mandrel and the adapter sleeve are made from a composite drillable material.

16. The tool string of claim 12, wherein a longitudinal gap exists between the adapter sleeve and the setting sleeve when the setting sleeve is in the first position.

17. The tool string of claim 12, wherein the plug further comprises first and second slips and first and second slip cones, wherein the slips and slip cones are disposed along the outer surface of the plug mandrel.

18. The tool string of claim 17, wherein the plug further comprises:

first and second expansion support rings each having two or more tapered wedges;

first and second expansion rings each deformable to fill a gap formed between the tapered wedges of a respective expansion support ring, wherein the sealing member is disposed between the first and second expansion rings.

19. The tool string of claim 18, wherein the tapered wedges are configured to extend radially when the setting sleeve is moved toward the second position.

20. The tool string of claim 18, wherein an outer surface of each expansion ring corresponds to an angle of the respective tapered wedges.

21. The tool string of claim 18, wherein the plug further comprises first and second expansion cones each disposed about opposite ends of the sealing member.

22. The tool string of claim 21, wherein the first and second expansion cones each comprise a tapered first section and a substantially flat second section.

23. The tool string of claim 22, wherein the second section abuts the sealing member.

24. The tool string of claim 22, wherein the first expansion ring is disposed about the tapered first section of the first expansion cone.

25. The tool string of claim 24, wherein the second expansion ring is disposed about the tapered first section of the second expansion cone.

26. The tool string of claim 12, further comprising one or more perforation guns longitudinally coupled to the setting tool mandrel.

27. The tool string of claim 12, wherein the adapter rod is releasably coupled to the plug mandrel with a shearable member.

* * * * *